United States Patent [19]

Howell, deceased et al.

[11] 4,169,265

[45] Sep. 25, 1979

[54] P-BAND LOOP ANTENNAS IN RADIAL ARRAY

[75] Inventors: James E. Howell, deceased, late of Huntsville, Ala., by Elizabeth L. Howell, executrix; Wayne T. Hudson, Huntsville, Ala.

[73] Assignee: The United States of America as represented by the Secretary of the Army, Washington, D.C.

[21] Appl. No.: 902,600

[22] Filed: May 4, 1978

[51] Int. Cl.[2] ..... H01Q 7/00; H01Q 1/28

[52] U.S. Cl. ..... 343/708; 343/742; 343/744

[58] Field of Search ..... 343/741, 742, 743, 744, 343/867, 890, 705, 708

[56] References Cited

U.S. PATENT DOCUMENTS

| | | | |
|---|---|---|---|
| 2,166,750 | 7/1939 | Carter | 343/744 |
| 2,293,136 | 8/1942 | Hampshire | 343/743 |
| 2,431,124 | 11/1947 | Kees et al. | 343/789 |
| 2,618,746 | 11/1952 | Pauch | 343/742 |
| 3,151,328 | 9/1964 | Boyer | 343/748 |
| 3,681,770 | 8/1972 | Alford | 343/799 |

FOREIGN PATENT DOCUMENTS

| | | | |
|---|---|---|---|
| 936029 | 9/1963 | United Kingdom | 343/799 |

*Primary Examiner*—Eli Lieberman

*Attorney, Agent, or Firm*—Nathan Edelberg; Robert P. Gibson; Robert C. Sims

[57] ABSTRACT

A P-band uniform loop antenna system simulating the small uniform in-phase current loop by using a number of smaller radiating elements that are connected in phase so that each current in each element is in phase. Thus, a small uniform loop radiation pattern is simulated, but the loop elements are arranged on a radius that is not small compared to a wavelength, and are located around a cylinder.

3 Claims, 3 Drawing Figures

P-BAND LOOP ANTENNAS IN RADIAL ARRAY

DEDICATORY CLAUSE

The invention described herein may be manufactured, used, and licensed by or for the Government for governmental purposes without the payment to me of any royalties thereon.

DESCRIPTION OF THE PREFERRED EMBODIMENT

The present antenna system may be used for P-band telemetry of any missile diameter as long as a sufficient number of elements are used. Advantages of this system are a roll symetrical radiation pattern nearly circular about the roll axis, and elements that are easily tunable.

Figure 1:
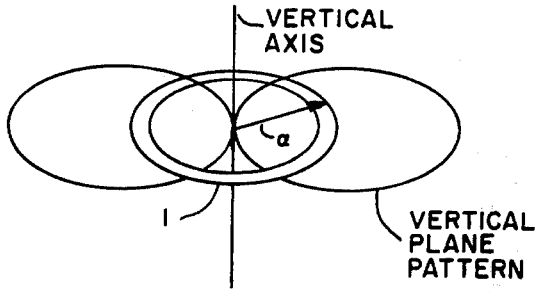
FIG. 1 is a diagrammatic representation of a circular loop.

Referring to FIG. 1 it is known that a circular loop of radius $\alpha$ with a uniform in-phase current radiates a doughnut shaped pattern with a maximum in the plane of the loop, and nulls perpendicular to the loop plane if the radius $\alpha$ is very small compared to a wavelength ($\alpha << \lambda$) where $\lambda$ is the wavelength.

Figure 2:
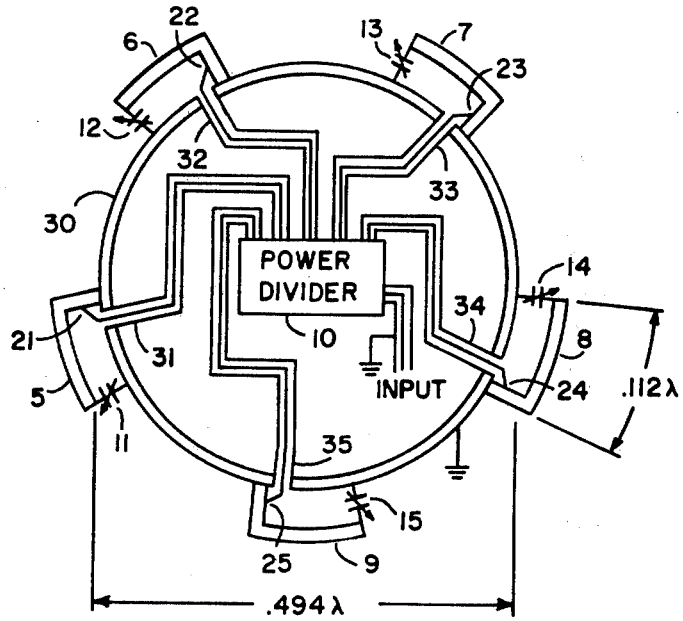
FIG. 2 is a diagrammatic representation of the present invention.
Figure 3:
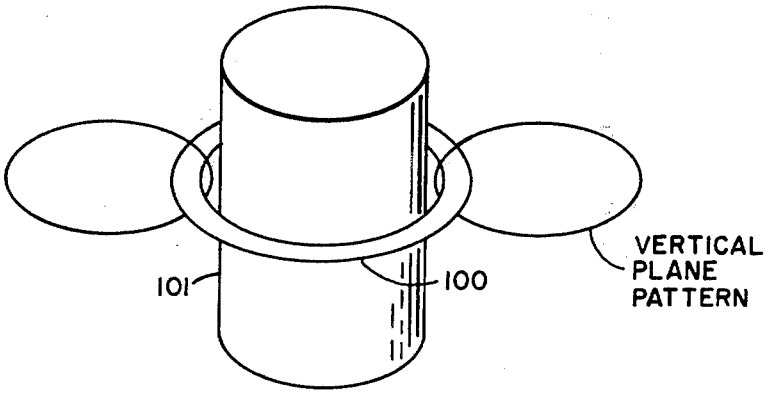
FIG. 3 is a diagrammatic representation of a uniform loop about a cylinder.

The P-band uniform loop antenna system of the present invention is shown in FIG. 2. The system simulates the uniform loop by using a number of smaller radiating elements 5–9 located on a diameter that is not small compared to a wavelength. These elements are connected in phase by power divider 10 so that each current in each element is in phase. In this manner a uniform loop around a cylinder is simulated giving a radiation pattern similar to a small uniform loop 100 shown in FIG. 3 about a cylinder 101 which is much smaller in diameter than the missile 30 of FIG. 2.

The radiating elements 5–9 are much shorter than a quarter wavelength long (0.112 of a wavelength) to simulate the in phase current condition of the uniform loop and are resonated by the variable capacitors 11–15 located at the end of the loop.

In addition, an impedance match is obtained by changing the feed points 21–25 up or down the loop until the desired impedance is obtained. Thus if a characteristic impedance of 50 ohms is desired, each loop could be adjusted for 50 ohms and a five way power divider 10 could be used, or each element could be adjusted to 250 ohms and fed in parallel to give an effective impedance of 50 ohms.

Each of the capacitors 11–15 will be individually tuned so as to be in resonance with the loops of 5–9. It should be noted that due to the resonate circuits, the path from the junction point on each loop to the skin of the missile 30 will not have any current flowing therethrough, as the path is a short loop having inductance. The skin of the missile 30 provides the returning path to power divider 10. The diameter of the missile skin 30 is about ½ wavelength (for example 0.494 of a wavelength) but this is not critical as long as enough elements are used to simulate in-phase currents about the circumference of the cylinder. The maximum length of each loop 5–9 would then be something less than one-fourth of the wavelength so that leadway will be given for the adjustments of the capacitors 11–15. In the example this length would be approximately 0.112 of the operating wavelength even though the circumference of the missile is greater than a wavelength. The power divider is fed through the skin through connections 31–35 to the junction points 21–25 using coaxial cable and coaxial connectors.

It is claimed:

1. An antenna system comprising a plurality of radiating elements distributed spatially on a radius that is not small compared to given wavelength but connected in phase so as to simulate a radiation pattern similar to a single loop radiation element with radius very small compared to the wavelength and uniform in-phase current; a plurality of capacitor elements; each of said capacitor elements being individually connected to a different one of said plurality of radiating elements; said system has an operating frequency; said capacitor and radiating elements being resonantly tuned to each other; each radiating element has one side connected to one side of one of the plurality of capacitor elements and the other side of the radiating element being connected to a common path; the other side of said capacitor element being connected to said common path; a power divider having a plurality of outputs connected to a junction between the ends of each radiating element and having a return side connected to said common path.

2. An antenna system as set forth in claim 1 wherein said common path is the skin of a missile.

3. An antenna system as set forth in claim 1 wherein the position of said junction can be varied and the value of said capacitor elements can be varied.

* * * * *